United States Patent [19]

Shemitz et al.

[11] Patent Number: 4,961,127

[45] Date of Patent: Oct. 2, 1990

[54] LAMP SOCKET MOUNTING BRACKET

[75] Inventors: Sylvan R. Shemitz, Woodbridge; Flemming Brygger, Guilford, both of Conn.

[73] Assignee: Sylvan R. Shemitz Associates, Inc., West Haven, Conn.

[21] Appl. No.: 349,582

[22] Filed: May 9, 1989

[51] Int. Cl.[5] ..... F21V 7/00

[52] U.S. Cl. ..... 362/285; 362/396; 362/306; 362/429; 439/360; 439/32; 439/541

[58] Field of Search ..... 362/288, 289, 294, 306, 362/257, 396, 226, 457, 458, 285, 219, 372, 429; 439/360, 365, 32, 529, 541, 540

[56] References Cited

U.S. PATENT DOCUMENTS

| | | | |
|---|---|---|---|
| 236,783 | 1/1881 | Coulter . | |
| 570,669 | 11/1896 | Lapworth . | |
| 1,228,521 | 6/1917 | Bell . | |
| 1,605,696 | 11/1926 | Bander . | |
| 2,343,691 | 3/1944 | Miller | 248/50 |
| 2,501,840 | 3/1950 | Bradford | 439/32 |
| 2,595,155 | 4/1952 | Mastrangelo | 439/641 |
| 2,601,142 | 6/1952 | Hubbard | 315/32 |
| 2,700,099 | 1/1955 | Pistey et al. | 240/51.12 |
| 3,485,601 | 7/1969 | Podbury et al. | 362/29 X |
| 3,541,492 | 11/1970 | Fenn | 339/52 |
| 3,737,656 | 6/1973 | Plana | 240/151 |
| 3,927,315 | 12/1975 | Werry | 240/52.1 |
| 4,039,822 | 8/1977 | Chan et al. | 240/73 BC |
| 4,514,793 | 4/1985 | Andreasen | 362/306 |
| 4,570,210 | 2/1986 | Kosmatka | 362/396 |
| 4,620,268 | 10/1986 | Ferenc | 362/74 |

FOREIGN PATENT DOCUMENTS

| | | | |
|---|---|---|---|
| 1278704 | 11/1961 | France | 362/396 |

*Primary Examiner*—Ira S. Lazarus
*Assistant Examiner*—D. M. Cox
*Attorney, Agent, or Firm*—Jeffrey H. Ingerman; Steven C. Bauman

[57] ABSTRACT

A lamp socket mounting bracket which contains a pair of mounting clamps and is mounted within a reflector. The mounting clamps have reflector ends and socket ends which each have feet. The mounting clamps have curved portions to encompass a lamp socket which forms a fulcrum within the lamp socket mounting bracket. A clamp adjusting means is used at the socket ends of the mounting clamps to tighten the mounting clamps around the lamp socket, help make a substantial contact between the mounting clamps and the lamp socket, and create, along with the fulcrum, a reverse scissors action within the lamp socket mounting bracket.

7 Claims, 2 Drawing Sheets

LAMP SOCKET MOUNTING BRACKET

BACKGROUND OF THE INVENTION

This invention relates to a device for mounting a lamp socket in a lighting fixture.

Known apparatus for mounting a lamp socket in a lighting fixture generally includes a metal heat sink bracket which is mounted in a reflector in the lighting fixture. The heat sink bracket has feet which, after insertion into slots in the reflector, are secured in place by a swaging operation which deforms the edges of the slot. The corresponding lamp socket has laterally extending plates which are then attached to the heat sink, for example, by screws. However, since the heat sink bracket and the lamp socket mate with slip-fits, heat generated during the operation of the lamp is not efficiently conducted away from the lamp base. This inefficient conduction of heat shortens the life of light bulbs in the lighting fixture.

Additionally, the heat sink bracket has to be installed in the reflector early in the lighting fixture assembly process because it has to be slid into the slots in the reflector, positioned to the desired longitudinal location, and then secured in place by deforming the reflector slot edges. Because the heat sink bracket can only be slid into an open end of the slot, this must occur before that open end is closed off by installation of endplates on the reflector.

Additionally, the heat sink bracket and lamp socket take a relatively long time to be installed because of the deformation of the reflector slot edges and securing of the lamp socket operations.

Additionally, the heat sink bracket cannot easily be repositioned or replaced because of the deformation of the reflector slot edges.

Therefore, there exists a need for brackets which will allow for (1) the more efficient conduction of heat away from the lamp base, (2) the brackets to be secured onto the reflector at any time during lighting fixture assembly process, (3) the brackets and lamp socket to be installed in the lighting fixture assembly in a shorter period of time, (4) the brackets to be adjustable after installation to accommodate different length light bulbs, (5) the brackets to be replaceable after installation to accommodate different diameter lamp sockets, (6) easy replacement of the socket within the brackets, and (7) prevention of the rotation of the socket within the bracket.

SUMMARY OF THE INVENTION

It is an object of this invention to provide a lamp socket mounting bracket that may be installed into the reflector at any time during the assembly of the lighting fixture.

It is also an object of this invention to provide a lamp socket mounting bracket and lamp socket that may be installed in the lighting fixture in reduced time.

It is also an object of this invention to provide a lamp socket mounting bracket to accommodate different length light bulbs.

It is also an object of this invention to provide a lamp socket mounting bracket that is replaceable with a different size lamp socket mounting bracket to accommodate different diameter lamp sockets.

It is also an object of this invention to provide a lamp socket mounting bracket that will conduct heat more efficiently away from the lamp socket and lamp base to the reflector and then to the surrounding environment.

It is also an object of this invention to provide for easy replacement of a socket within a lamp socket mounting bracket.

It is also an object of this invention to for the prevention of the rotation of the socket within the bracket.

This invention provides a clamp-action mounting bracket for holding a lamp socket in place within a lighting fixture. The lamp socket mounting bracket is comprised of two mounting clamps, which are substantially mirror images of each other. The mounting clamps are positioned in the reflector part of the lighting fixture and extend from the reflector around the lamp socket. The distance between the mounting clamps may be adjusted by a clamp adjusting means.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which.

DETAILED DESCRIPTION OF THE INVENTION

Figure 1:
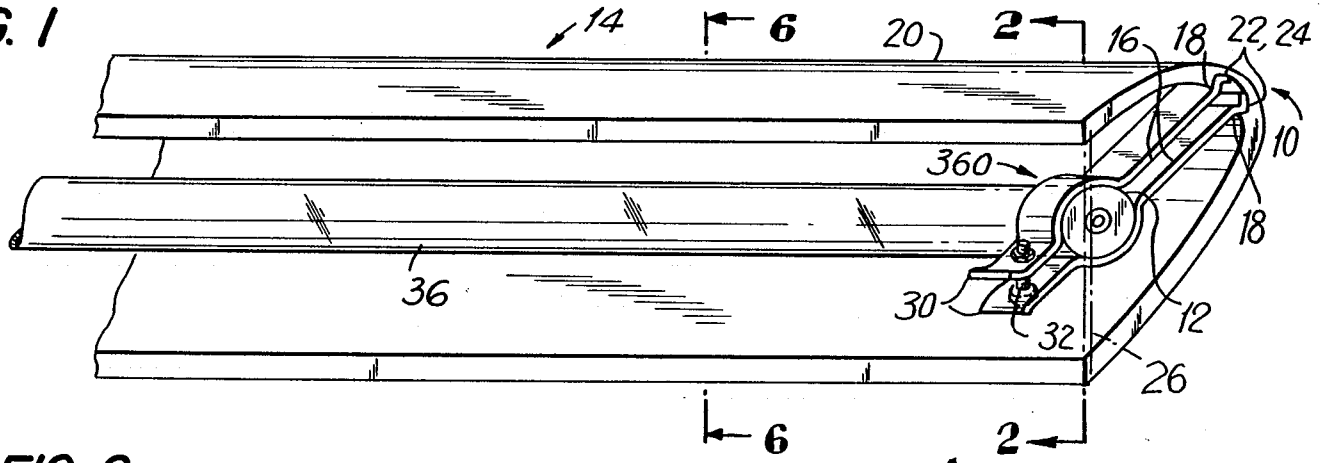
FIG. 1 is a perspective view of a lamp socket mounting bracket according to the invention installed in the reflector of a lighting fixture.

The lamp socket mounting bracket 10 comprises two mounting clamps 16 which secure a lamp socket 12 in place in the lighting fixture 14. Clamps 16 are substantially mirror images of each other and are installed in reflector slots 18 in the reflector 20. At the reflector end 22 of each mounting clamp, a foot 24 is formed to fit in the reflector slot 18. Because the bracket 10 is in two pieces, each foot 24 may be inserted separately in the reflector slot 18 and then the halves may be brought together facing each other. Thus, the feet 24 do not have to be inserted into the reflector slot from one open end and so this installation may occur at any time during the process of assembling lighting fixture 14, even after endplates 26 have been installed.

A lamp socket 12 is placed between the clamps 16 and the clamps 16 are brought closer to one another at the socket ends 30 by a clamp adjusting means 32, such as screw 320 and nut 321. When the clamps 16 are brought closer to one another, they tighten around and secure the lamp socket 12. Alternatively, clamps 16 may be tightened around a projection from lamp socket 12, such as a nipple (not shown).

Heat is efficiently conducted away from the lamp socket 12 and lamp base 360 of lamp 36, which may be any one of a number of types of elongated lamps such as tungsten halogen, metal halide, or high pressure sodium, to the reflector 20 because of a relatively large amount of surface area in tight contact between the lamp socket 12 and the mounting bracket 10. The heat is then transferred to the surrounding environment by radiation and convection. This more efficient heat transfer, as compared to known lighting fixtures, results in cooler operation of lamp base 360 and so extends the life of lamp 36.

When the mounting clamps 16 are brought closer to one another by the clamp adjusting means 32, the reflector ends 22 of the clamps 16 spread apart, because the lamp socket 12 acts as an interior fulcrum. Tightening the clamp adjusting means 32 spreads apart feet 24, causing them to make a tight contact with the sides of the reflector slot 18. This spreading and closing effect can be characterized as a reverse scissor action.

Figure 3:
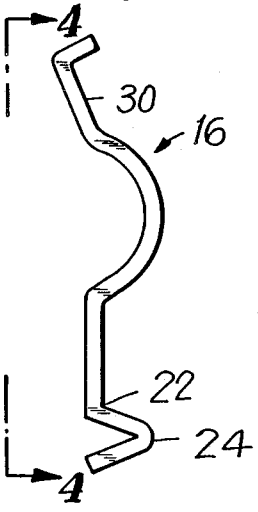
FIG. 3 is a side elevational view of a mounting clamp according to the invention.
Figure 2:
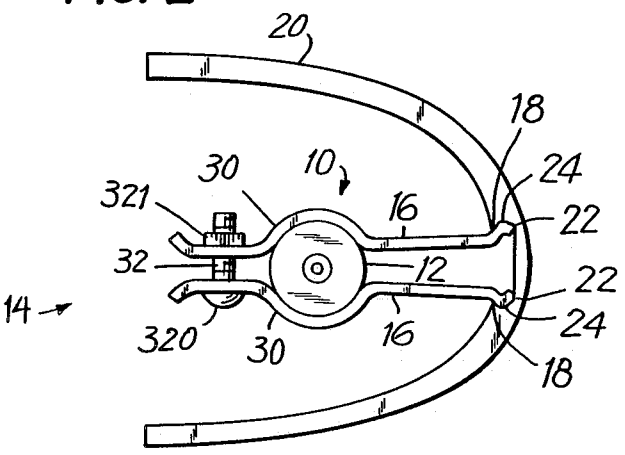
FIG. 2 is an inverted side elevational view, taken from line 2—2 of FIG. 1, of the reflector and of the mounting clamps securely encompassing the lamp socket.

Although as shown in the FIGS. 1–3 both mounting clamps 16 are identical, it is possible that they may be only substantially identical. For example, if it is desired to relocate the axis of lamp 36 or to provide easier access to screw 320, the two clamps 16 may have complementary opposing bends in them.

Figure 4:
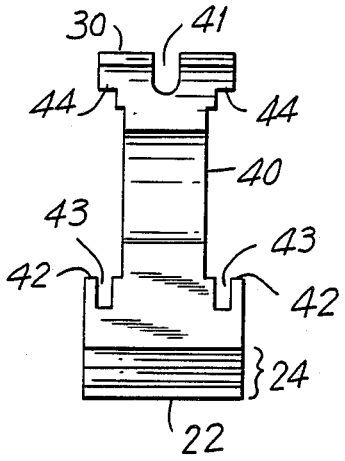
FIG. 4 is an interior side elevational view of a particularly preferred embodiment of a mounting clamp according to the invention, taken in the direction of line 4—4 of FIG. 3.
Figure 5:
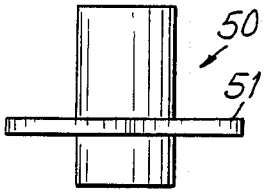
FIG. 5 is an elevational view of a lamp socket adapted for use with the mounting clamp of FIG. 4.
Figure 6:
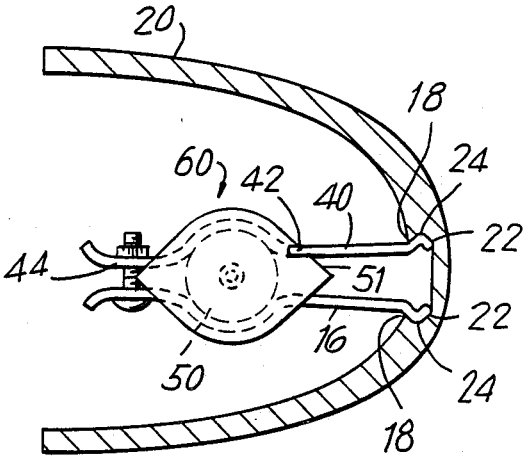
FIG. 6 is an inverted side view, partly in section, taken from line 6—6 of FIG. 1, of an assembled lamp socket mounting bracket using the mounting clamp of FIG. 4 and the lamp socket of FIG. 5.

A particularly preferred embodiment of a mounting clamp according to this invention is shown in FIG. 4. Mounting clamp 40 is similar to mounting clamp 16. For example, like mounting clamp 16, mounting clamp 40 has a slot, shown at 41, for receiving screw 320. However, mounting clamp 40 has fingers 42, not present on mounting clamp 16, forming notches 43, and also has tabs 44 not present on mounting clamp 16. Notches 43 and tabs 44 cooperate with flange 51 of lamp socket 50, shown in FIG. 5, which is specially designed to be used with mounting clamps 40. The cooperation of flange 51 with notches 43, illustrated in FIG. 6, prevents axial translation of lamp socket 50 during assembly of lamp socket mounting bracket 60. The cooperation of flange 51 with both notches 43 and tabs 44 prevents axial rotation of lamp socket 50. Of course, once clamp adjusting means 32 is tightened, neither rotation nor translation of lamp socket 50 is possible with or without notches 43, tabs 44 and flange 51. As shown in FIG. 6, only one of the mounting clamps is a mounting clamp 40, having notches 43 and tabs 44, the other mounting clamp being a mounting clamp 16, but it is also possible for both of the mounting clamps to be mounting clamps 40. It is also possible to provide other means for preventing rotation and translation of the lamp socket during assembly. For example (not shown), lamp socket 12 could be provided with a base plate perpendicular to its longitudinal axis, and one or both of mounting clamps 16 could be provided with a turned up tab on the side away from the lamp, forming an elongated slot to engage the base plate. The mating of the base plate to the slot prevents axial translation, while the elongated nature of the slot, which engages an elongated edge of the base plate, prevents axial rotation.

Another feature of the present invention is its speed of installation. The lamp socket mounting bracket 10 and a lamp socket 12 may be installed in less time than it takes to install known apparatus for mounting a lamp socket 12 in a lighting fixture 14 such as a metal heat sink bracket and a lamp socket 12. This device may also be repositioned in the reflector slot 18 after installation due to the reverse scissor action and thus accommodate different length lamps 36. This is possible because the reverse scissor action causes socket ends 30 to spread apart when the clamp adjusting means 32 is loosened. As socket ends 30 spread apart, reflector ends 22 and feet 24 are drawn together. Thus, lamp socket mounting bracket 10 is loosened in reflector slot 18. This can take place after assembly of lighting fixture 14, should the user desire to change the length of lamp 36.

Lamp socket mounting bracket 10 may also be interchanged later with a different size lamp socket mounting bracket 10 and thus accommodate different diameter lamp sockets 12. This is also possible because of the reverse scissor action. Also, a lamp socket 12 can be loosely assembled into the lamp socket mounting bracket 10 and this sub-assembly can then be installed into lighting fixture 14 as a unit.

Thus it is seen that a lamp socket mounting bracket that achieves the objects set forth above is provided. One skilled in the art will appreciate that the present invention can be practiced by other than the described embodiment, which is presented for purposes of illustration and not of limitation, and the present invention is limited only by the claims that follow.

What is claimed is:

1. A device for mounting a lamp socket in a reflector, comprising:

a pair of mounting clamps each having a reflector end and a socket end; wherein:

the reflector has a clamp receiving slot formed therein;

each mounting clamp has a curved portion located intermediate the socket end and reflector end, the curved portion arranged to form, when the mounting clamps are positioned opposite one another, a generally circular recess for receiving a lamp socket with the lamp socket being located in the recess and forming a fulcrum; the device further comprising:

clamp adjusting means located at the socket ends for adjustably connecting the two socket ends of the pair of clamps; wherein:

the fulcrum forms a pivot point to spread apart the feet in the clamp receiving slot as the socket ends are urged together by the clamp adjusting means.

2. A device as recited in claim 1, wherein the mounting clamps contact a substantial portion of the lamp socket to conduct heat away from the lamp base.

3. A device as recited in claim 1, wherein the coaction of the fulcrum and the clamp adjusting means is capable of both drawing together and spreading apart the feet of the clamp in a reverse scissor action.

4. A device as recited in claim 1, wherein the mounting clamps are adjustably located in the clamp receiving slot in the reflector to accommodate different length lamps.

5. A device as recited in claim 1, wherein the mounting clamps are removably and replaceably received in the clamp receiving slot in the reflector and can be interchanged with different size mounting clamps to accommodate different diameter lamp sockets.

6. A device as recited in claim 1, further comprising means for preventing axial rotation and axial translation of said lamp socket.

7. A device as recited in claim 6 wherein said rotation and translation preventing means comprises complementary elements on said lamp socket and at least one of said mounting clamps.

* * * * *

UNITED STATES PATENT AND TRADEMARK OFFICE

CERTIFICATE OF CORRECTION

PATENT NO. : 4,961,127

DATED : October 2, 1990

INVENTOR(S) : Sylvan R. Shemitz et al.

It is certified that error appears in the above-identified patent and that said Letters Patent is hereby corrected as shown below:

Cover page, References Cited, U.S. PATENT DOCUMENTS, "3,485,601 7/1969 Podbury et al. ... 362/29X" should be -- 4,845,601 7/1989 Podbury et al. ... 362/294 --.

Column 2, line 6, after "to" should be inserted -- provide --.

Signed and Sealed this

Eighth Day of February, 1994

Bruce Lehman

*Attest:*

BRUCE LEHMAN

*Attesting Officer*

*Commissioner of Patents and Trademarks*